US005913789A

United States Patent [19]

Varre et al.

[11] Patent Number: 5,913,789

[45] Date of Patent: Jun. 22, 1999

[54] CONSTRUCTION ELEMENT AND GUIDE CHANNEL FOR SMOKE PIPE

[75] Inventors: Stian Varre, Lommedalen; Morten Henriksen, Drøbak, both of Norway

[73] Assignee: Peismakern AS, Baerum, Norway

[21] Appl. No.: 08/945,263

[22] PCT Filed: Apr. 15, 1996

[86] PCT No.: PCT/NO96/00086

§ 371 Date: Oct. 17, 1997

§ 102(e) Date: Oct. 17, 1997

[87] PCT Pub. No.: WO96/33322

PCT Pub. Date: Oct. 24, 1996

[30] Foreign Application Priority Data

Apr. 20, 1995 [NO] Norway ..... 951495
Sep. 13, 1995 [NO] Norway ..... 953616

[51] Int. Cl.[6] ..... E04B 1/00

[52] U.S. Cl. ..... 52/302.1; 52/784.15; 52/794.1

[58] Field of Search ..... 52/784.15, 794.1, 52/603, 309.12, 405.1, 302.3, 302.1

[56] References Cited

U.S. PATENT DOCUMENTS 773,647 11/1904 Kidder .
3,540,116 11/1970 Drahos et al. ..... 52/430
5,187,913 2/1993 Leveau ..... 52/584
5,262,217 11/1993 Blaauw ..... 428/49
5,313,753 5/1994 Sanger ..... 52/251
5,351,454 10/1994 Hahne et al. ..... 52/309.17
5,440,846 8/1995 Record ..... 52/309.15

FOREIGN PATENT DOCUMENTS 415 845 4/1980 Sweden .
1 252 562 11/1971 United Kingdom .

*Primary Examiner*—Carl D. Friedman
*Assistant Examiner*—Dennis L. Dorsey
*Attorney, Agent, or Firm*—Barry R. Lipsitz; Ralph F. Hoppin

[57] ABSTRACT

A thermal insulating or fire retardant construction element (1) is described, consisting of outer layers (5,6) of glass fibre reinforced concrete and a mineral wool layer (4) between the outer layers (5,6). At the back of the panel (1) a cavity (7) is formed to permit circulation of air between the panel (1) and the wall therebehind. A lead-through duct is also described for leading a smoke pipe from a fireplace to a chimney through the element, the external face of the duct communicating with the air space behind the element.

20 Claims, 4 Drawing Sheets

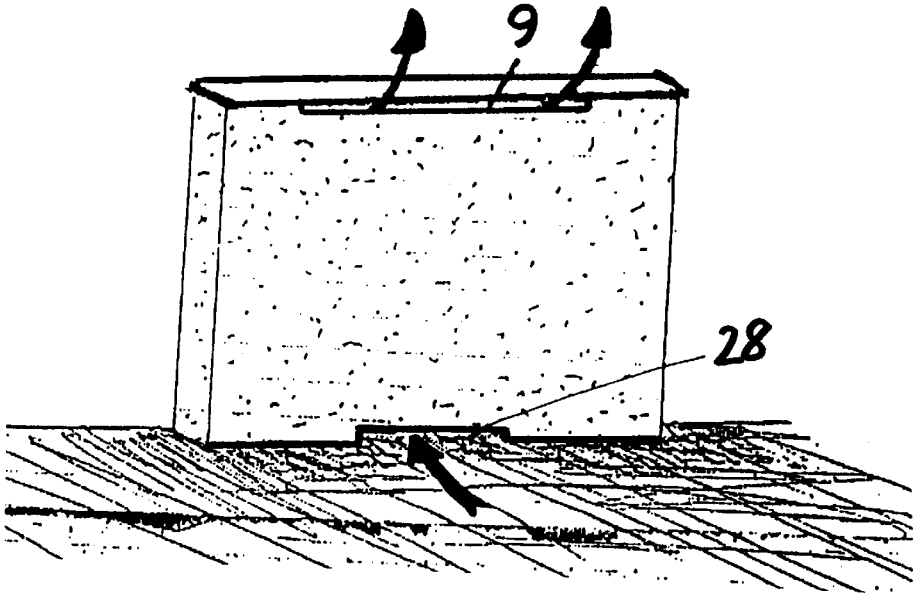
Fig. 4
Fig. 5
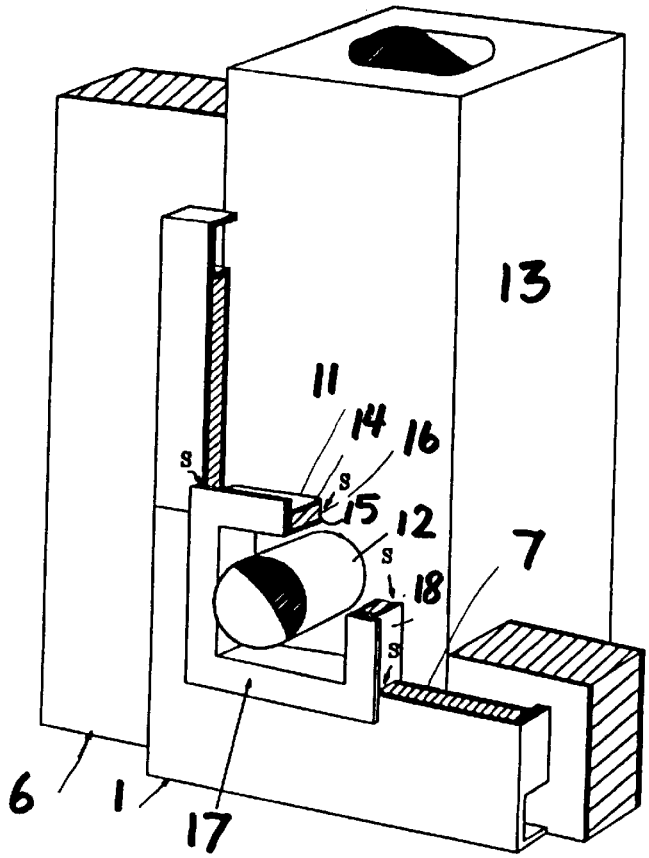

CONSTRUCTION ELEMENT AND GUIDE CHANNEL FOR SMOKE PIPE

BACKGROUND OF THE INVENTION

The present application relates to a thermal insulating or fire retardant construction element and a lead-through duct for leading smoke pipes therethrough, in accordance with the preamble in claims 1 and 8 below.

To date, it has been usual to construct thermal insulating or fire retardant walls, for example, in connection with fireplaces, with construction blocks of solid, isotropic material, such as, e.g., Leca (light expanded clay aggregate) or Siporex. This is a very labour-intensive operation, as the construction blocks must first be laid one by one and then the wall must be plastered. This takes a long time and causes a lot of dust and dirt in the vicinity the work place. Moreover, the weight of a wall of this kind is great, about 90 kg/m$^2$ wall.

Construction elements comprising layers of insulating material are known in general from, e.g., SE 415 845 and GB-1 252 562. However, these are designed for the outer walls of a construction and are not constructed for and will not be suited to insulation between a fireplace and a combustible wall.

SUMMARY OF THE INVENTION

According to the present invention, a thermal insulating and fire retardant construction element is provided which can be installed by a fireplace in a far simpler, faster and cleaner manner than conventional structures. This element is characterised in that it consists of an outer layer of reinforced concrete and an intermediate layer consisting of thermal insulating or fire retardant insulating material which withstands high temperatures, and that the panel has at least one cavity on the side that is to face in towards the construction wall, with one or more openings at the lower edge and the upper edge of the panel to permit circulation of air between the panel and the wall therebehind. This is also disclosed in the priority application, NO 951495, of the present application.

The element according to the invention can be installed as a thermal-insulating or fire retardant wall in full height. Consequently, there is no need to build the wall up of more elements. The wall does not weigh more than about 30 kg/m$^2$ wall and so is easy to transport. The element can quite simply be put in place and bonded to the wall behind by means of, e.g., cement paste.

The low weight of the element will allow greater scope with regard to the weight of the actual fireplace, e.g., the fireplace insert, as there are strict weight limitations governing the weight of everything which is located within a certain area around the fireplace. Thus, it is possible to make larger and more resplendent fireplaces if so desired.

According to one embodiment of the present invention air is to circulate behind the element in that air flows in through openings at the lower edge of the element and out through openings at the upper edge thereof. However, in the priority application of this application there is nothing to suggest how the openings could be positioned, even though it would be correct to say that there is an indication that the openings at the upper edge may be on the top of the element. One of the objectives of the present application is to provide a practical solution with regard to the positioning of these openings, so that the desired air circulation effect is achieved and at the same time the drawbacks of dust accumulation and the risk of articles falling behind the element are minimized whilst allowing greatest possible flexibility with a view to the positioning of the stove or fireplace.

This is achieved by positioning at least the lower openings in one or both vertical end faces of the element.

To enable this construction element to be used in connection with stoves or fireplaces, it must be feasible to feed a smoke pipe through the element to the chimney behind.

Today, the minimum requirement with regard to the space between the smoke pipe and the closest combustible material is 23 cm. This causes major problems as many chimneys are so narrow that it is simply not possible to achieve 23 cm of chimney on each side of the smoke pipe. To comply with the regulations, a part of the combustible wall must be pulled down in the vicinity of the chimney and be replaced with a fire wall. Naturally, this requires major reconstruction, and is also of course expensive. In fact the alternative often resorted to is simply a contravention of the regulations. This happens frequently.

The present invention provides a solution to this problem, there being provided a lead-through duct for leading the smoke pipe from the fireplace to the chimney, through a construction element having air circulation at the back, where the external face of the duct communicates with this air space.

The invention will now be described in more detail with reference to the attached drawings in its place.

BRIEF DESCRIPTION OF THE DRAWINGS

FIG. 4 illustrates a second embodiment of a thermal insulating or fire retardant construction element;

FIG. 5 is a perspective view of a lead-through duct according to the invention in a first embodiment;

DETAILED DESCRIPTION OF THE INVENTION

Figure 1:
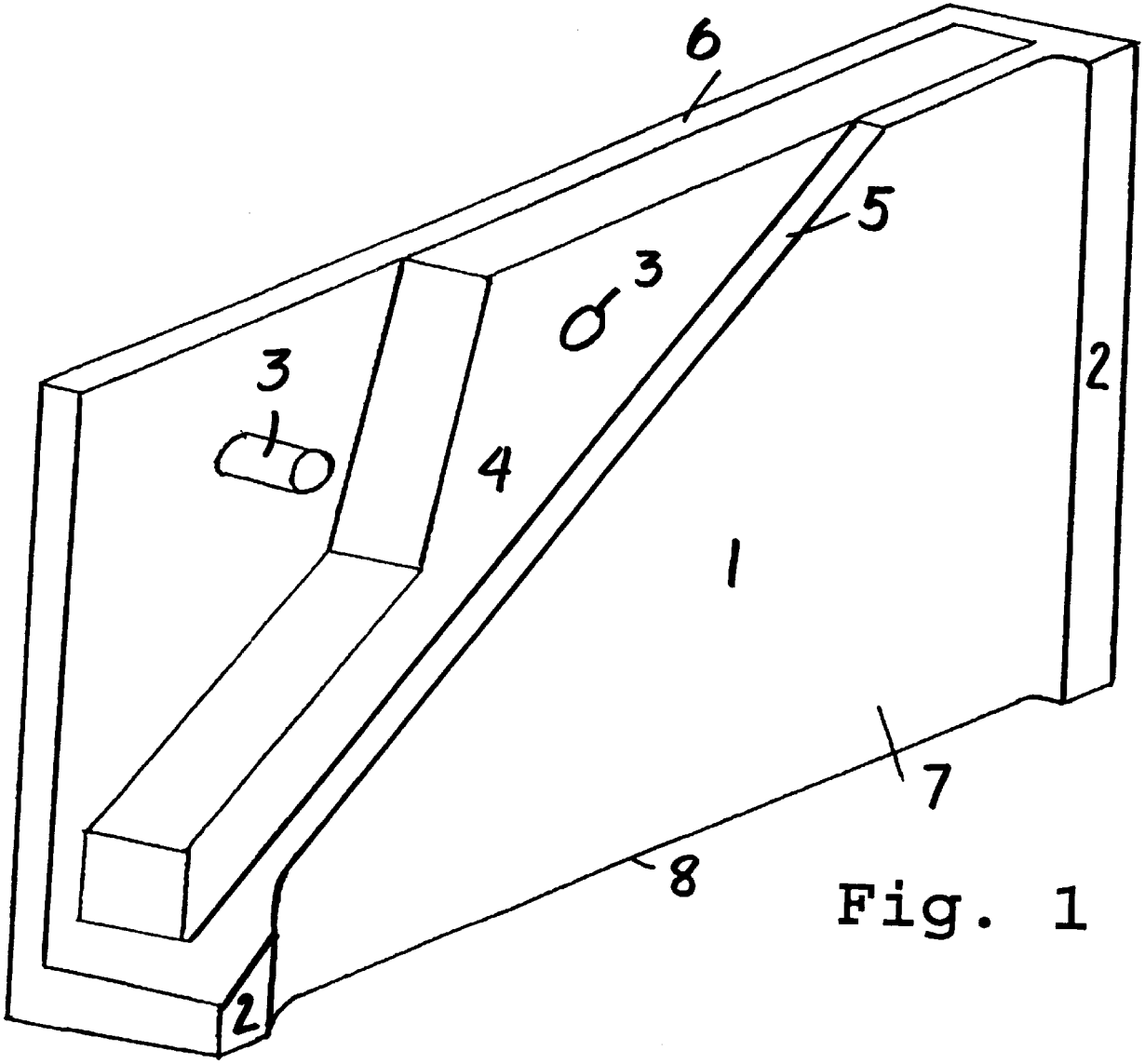
FIG. 1 is a perspective view of a thermal insulating or fire retardant construction element according to the invention.

Reference is made to FIG. 1 wherein a thermal insulating or fire retardant construction element 1 is preferably made of glass fibre reinforced lightweight concrete, having an encased mat or similar of a thermal insulating or fire retardant material such as rock wool.

Spacers 3 may be inserted between the two outer layers 5 and 6 of the construction element to help increase the rigidity of the element and to hold the outer layers 5 and 6 at the correct distance from one another. These spacers 3 may, for example, be cast in one piece with both or one of the outer layers 5, 6 of the concrete element 1.

On the side of the concrete element 1 which is to face in towards the house wall, there is provided a plurality, preferably two, vertical distance strips 2 along the side edges of the concrete element. Thus, one or more cavities 7 are formed at the back of the concrete element 1. By positioning openings (not shown) along the lower edge 8 of the concrete element 1, circulation of air is permitted from below, up between the rear of the concrete element and the house wall, and out of the top of the element 1. The back of the element 1 and the wall behind are thus cooled.

With the aid of the thermal insulating or fire retardant construction element according to the invention, it will be possible to position fireplaces close to walls of combustible material, such as wooden walls. The thickness of the element is very small compared with what is necessary in conventional structures. The necessary thickness will in fact not be more than about 6–7 cm, whilst the requirements for conventional fire walls are as much as 10 cm+plaster.

Designs may be provided on the surface of the element, e.g., a brick pattern, which gives the desired finish. The element may also be painted or wallpapered.

Although the above description is of a element especially for thermal insulating or fire retardant walls around a fireplace, it is obvious that a element of this kind could also be used in other places where it is desirable to insulate against heat or prevent the spread of fire, such as separating walls in commercial constructions, factories or similar. It could also be used as a floor or ceiling element for, e.g., computer rooms or other rooms which require special protection against heat or fire, or, e.g., store rooms wherein inflammable substances are stored.

Figure 2:
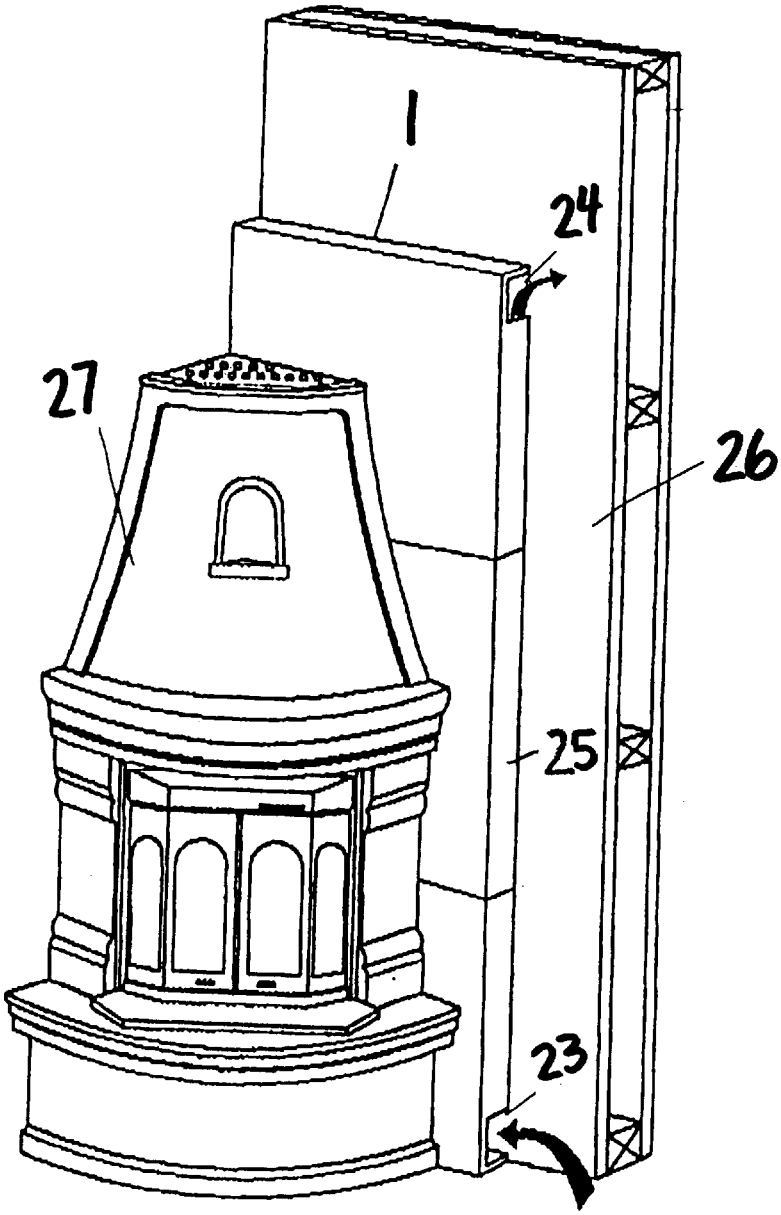
FIG. 2 is a perspective frontal view of a thermal insulating or fire retardant construction element according to the invention.
Figure 3:
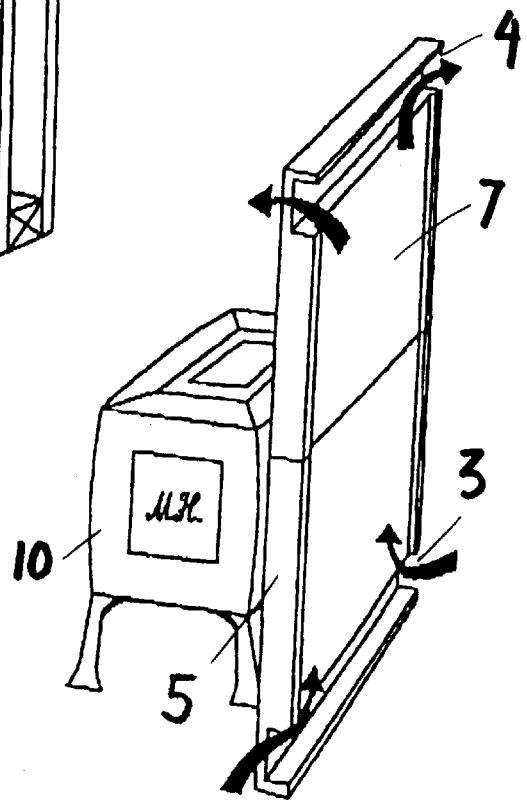
FIG. 3 is a rear perspective view of a thermal insulating or fire retardant construction element according to the invention.
Figure 6:
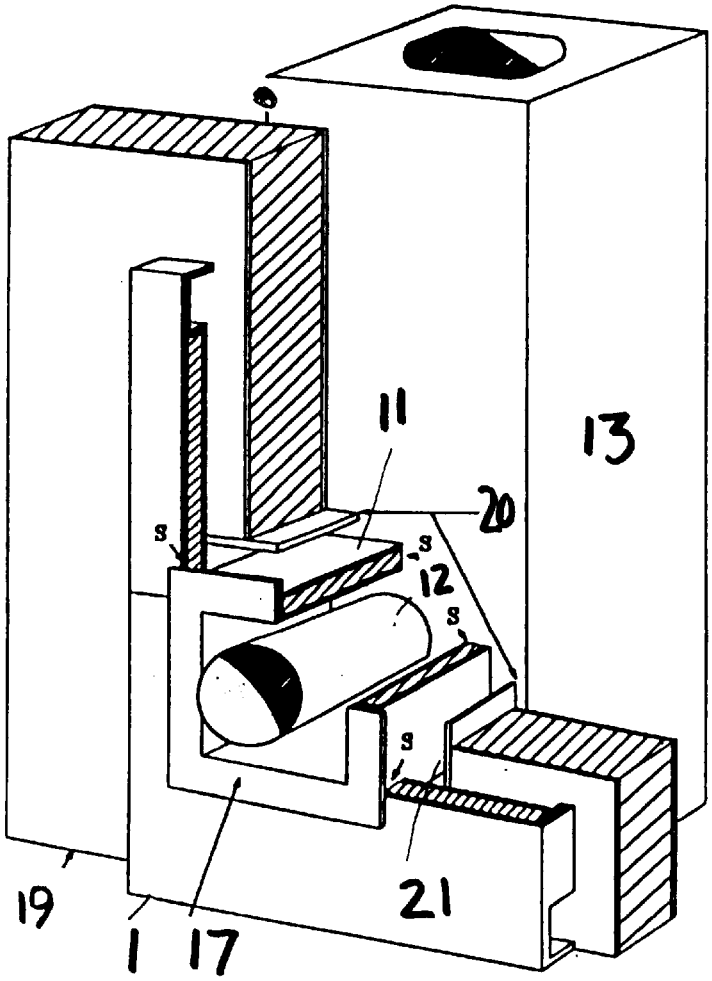
FIG. 6 is a perspective view of a lead-through duct according to the invention in a second embodiment.
Figure 7:
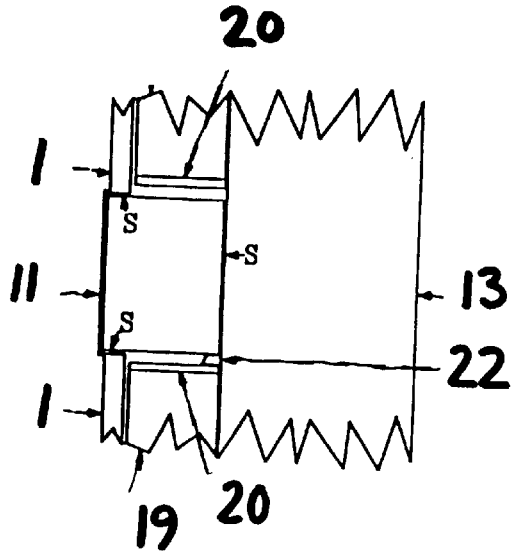
FIG. 7 is a sectional view of a lead-through duct according to the invention.

In FIGS. 2 and 3 a element according to the invention is shown mounted in place. On the side of the concrete element 1 which is to face in towards the house wall, there is provided, as mentioned above, one or more cavities 7. Openings 23 and 24 are provided in the vertical end edge 25 of the concrete element 1, at least one opening at the bottom and at least one opening at the top. With the aid of these openings, circulation of air is permitted from below through the opening 23, up between the back of the concrete element and a wall 26 behind, and out through the opening 24 in the element 1. The back of the element 1 and the wall behind are thus cooled. By arranging the openings 23 and 24 in this way it is possible to position, e.g., a fireplace 27 right against the construction element 1 without it being necessary to ensure passage of air under the fireplace or therethrough, as would have had to be done had the lower opening been positioned in the same way as the opening 28 according to FIG. 4.

The upper opening will to advantage also be positioned in the end face in the same way as the opening 24 in FIGS. 2 and 3. This also makes it possible to position a fireplace which extends all the way up to the ceiling right against the construction element 1. If the upper opening is not positioned thus, it may alternatively be positioned in the same way as the opening 9 in FIG. 4. That the openings 24 and 9 only open horizontally will make it difficult for dust and dirt to penetrate into the openings and down behind 7 the element 1. It is also fully possible to make use of the entire space on top of the element 1 as a shelf, if so desired, without there being any risk of articles falling down behind the element 1.

If a stove is to be installed, such as, e.g., the stove 10 in FIG. 3, which, of course, has a through-going opening under the actual fireplace, naturally the opening 28 in the front of the element may be used. However, here there will be a greater risk of pushing dirt into the opening 28 when, e.g., cleaning than in the case of the opening 23. This can be avoided by positioning the opening a short distance above the floor.

FIG. 5 illustrates a first embodiment of a lead-through duct 11 for leading a smoke pipe from a fireplace to a chimney 13. The duct 11 is to advantage constructed in the same way as the element 1, with outer layers 14,15 of concrete and an intermediate layer 16 of a thermal insulating material. At the end of the duct which faces towards the fireplace it is expedient to place a flange 17. Between the duct 11 and the chimney and between the flange 17 and the element 1 it is expedient to use silicone to prevent "heat bridges" at these points. The external face of the duct 11 communicates with the air space at the back 7 of the element 1. The air thus flows along the back 7 of the element 1 along the outside 18 of the duct 11 and cools this. This air cooling is in fact so efficient that the duct 11 and the element 1 have actually already passed SINTEF's (the Foundation for Scientific and Industrial Research at the University of Trondheim, Norway) stringent tests and formal approval will probably be granted very soon.

If there is a wall of a combustible material, e.g., wood, between the chimney and the intended fireplace, hitherto it has been necessary to remove this wall and replace it with a new one of a non-combustible material, in reality a brick wall. With the duct according to the present invention this is no longer necessary. Now it is only necessary to cut out a hole 21 in the wooden wall 19 which is a little larger than the external measurements of the duct 11. A spacer frame 20, which ensures the correct distance between the duct 11 and the wooden wall 19 is then placed inside the hole 21. A spacer 22 may be used to ensure that the correct distance is achieved between the duct 11 and the spacer frame 20. This is important in order to obtain a sufficiently large air space around the duct 11. Despite a small space between the smoke pipe 12 and combustible material, it is possible in this way to obtain sufficiently low temperatures on the surface of the combustible material 19 which faces towards the smoke pipe 12, so that even the most stringent temperature requirements are met. The table below shows a practical test of different types of fire walls with and without circulation of air behind the wall. The table shows clearly that by using a fire wall with an air gap a far lower temperature is reached behind the wall after 8.5 hours than after 4 hours with a fire wall with no air gap.

Test of heat load on a wooden wall behind a 10 cm fire wall:

Maximum flue gas temperature: 750° C.

Average flue gas temperature: 300–500° C.

Room temperature: about 21° C.

Heat output of fireplace: about 14 kW at normal load

| Distance to fire wall | 10 cm w/o air gap behind wall | 25 cm w/o air gap behind wall | 10 cm w/ 15 mm air gap behind wall | 10 cm w/ baffle plate, and 15 mm air gap in front of wall |
|---|---|---|---|---|
| Temp. of chipboard | | | | |
| Back: | 90° | 80° | 70° | 20–40° |
| Side: | 100° | 100° | 76° | |
| Temp. of fire wall: | 140–180° | 110–150° | Max. 220° Average 150–180° | |
| Test stopped after: | 4 hours | 6.5 hours | 8.5 hours | 9.25 hours |

The test were stopped when the temperatures became too high or when stationary conditions were reached.

What is claimed is:

1. A thermal insulating or fire retardant construction element, for positioning between a fireplace and a combustible construction wall comprising:

outer layers of reinforced concrete;

an intermediate layer of thermal insulating or fire retardant insulating material which withstands high temperatures;

at least one cavity on a side of said element which is to face in towards the construction wall; and one or more openings near a lower edge of the element and near an upper edge thereof, in order to permit circulation of air between the element and the wall behind, from the one or more openings near the lower edge up to, and out through, the one or more openings near the upper edge, to cool said side of said element and said construction wall.

2. An element according to claim 1, wherein:

the concrete is glass fibre reinforced.

3. An element according to claim 1, wherein:

the openings near the upper edge of the element are arranged in one or both vertical end faces of the element.

4. An element according to claim 1, wherein:

the insulating material comprises mineral wool.

5. An element according to claim 4, wherein:

said mineral wool comprises rock wool.

6. An element according to claim 1, wherein:

the openings near the lower edge of the element are arranged in one or both vertical end faces of the element.

7. An element according to claim 6, wherein:

spacers, are provided between the outer layers to maintain a desired distance between the outer layers; and said spacers extend through the insulating material.

8. An element according to claim 6, wherein:

the insulating material comprises mineral wool.

9. An element according to claim 8, wherein:

said mineral wool comprises rock wool.

10. An element according to claim 1, wherein:

spacers are provided between the outer layers to maintain a desired distance between the outer layers; and said spacers extend through the insulating material.

11. An element according to claim 10, wherein:

said spacers are cast in one piece with at least one of the outer layers.

12. An element according to 10, wherein:

the insulating material comprises mineral wool.

13. An element according to claim 12, wherein:

said mineral wool comprises rock wool.

14. An element according to claim 12, wherein:

said at least one cavity allows air to circulate between the element and the wall, from the one or more openings near the lower edge up to, and out through, the one or more openings near the upper edge.

15. An element according to claim 1, wherein:

the insulating material is of a type which withstands temperatures of at least 300° C. without undergoing structural changes.

16. A panel according to claim 15, characterized in that the concrete is glass fibre reinforced.

17. An element according to claim 15, wherein:

the insulating material comprises mineral wool.

18. An element according to claim 17, wherein:

said mineral wool comprises rock wool.

19. An element according to claim 15, wherein:

spacers are provided between the outer layers to maintain a desired distance between the outer layers; and said spacers extend through the insulating material.

20. An element according to claim 19, wherein:

said spacers are cast in one piece with at least one of the outer layers.

* * * * *